US008302814B2

(12) United States Patent
Breault et al.

(10) Patent No.: US 8,302,814 B2
(45) Date of Patent: Nov. 6, 2012

(54) RETRACTABLE SEALANT DISPENSING APPARATUS FOR SQUEEZE TUBE

(75) Inventors: John P. Breault, New Britain, CT (US); Steven J. Hemsen, Southington, CT (US)

(73) Assignee: Henkel Corporation, Rocky Hill, CT (US)

( * ) Notice: Subject to any disclaimer, the term of this patent is extended or adjusted under 35 U.S.C. 154(b) by 724 days.

(21) Appl. No.: 12/261,657

(22) Filed: Oct. 30, 2008

(65) Prior Publication Data

US 2009/0114678 A1 May 7, 2009

Related U.S. Application Data

(60) Provisional application No. 61/001,529, filed on Nov. 2, 2007.

(51) Int. Cl.
*B65D 35/28* (2006.01)

(52) U.S. Cl. ..... 222/95; 222/391

(58) Field of Classification Search ..... 222/92–107, 222/325–327, 391, 214
See application file for complete search history.

(56) References Cited

U.S. PATENT DOCUMENTS

| | | | | |
|---|---|---|---|---|
| 1,965,271 | A * | 7/1934 | Wharton | 222/95 |
| 3,933,273 | A * | 1/1976 | Cox | 222/1 |
| 4,125,206 | A * | 11/1978 | Wilson | 222/101 |
| 4,805,805 | A * | 2/1989 | Ocheskey | 222/102 |
| 6,454,138 | B1 * | 9/2002 | Greenhill et al. | 222/391 |

FOREIGN PATENT DOCUMENTS

WO WO 00/10880 3/2000

* cited by examiner

*Primary Examiner* — Lien Ngo
(74) *Attorney, Agent, or Firm* — Steven C. Bauman

(57) ABSTRACT

A dispensing apparatus provides for the dispensing of product from a collapsible tube. The apparatus includes a body for supporting the tube. The body has a forward end for accommodating a dispensing end of the tube and rearward end for accommodating a closed end of the tube. An elongate actuatable plunger is supported by the body. The plunger includes an elongate rod and a base attached to the rod. Actuating means is provided for effecting movement of the plunger in a first direction along the body for engagement with the collapsible tube wall thereby deforming the tube wall and dispensing the contents of the tube from the dispensing end. The actuating means also provides for retractable movement of the plunger in the second direction opposite the first direction. The base is positioned on the rod for dispensing engagement with the tube upon movement of the plunger in the first direction and movable out of dispensing engagement with the tube upon in a second direction.

16 Claims, 3 Drawing Sheets

RETRACTABLE SEALANT DISPENSING APPARATUS FOR SQUEEZE TUBE

CROSS-REFERENCE TO RELATED APPLICATIONS

The present application claims priority under 35 U.S.C. §119(e) of U.S. Provisional Patent Application Serial No. 61/001,529, filed Nov. 2, 2007, the complete disclosure of which is hereby incorporated by reference for all purposes.

FIELD OF THE INVENTION

The present invention relates generally to dispensers for dispensing a product from a squeeze tube. More specifically, the present invention is directed to a dispensing apparatus which is designed to dispense product from a collapsible tube and permit easy removal of the collapsed tube therefrom.

BRIEF DESCRIPTION OF RELATED TECHNOLOGY

Collapsible tubes are used to package various products such as adhesives. The products may be dispensed from the collapsible tubes by squeezing the body of the tube to dispense an amount of the product through a dispensing opening at one end of the tube. Many tubes of this type many be manually operated by squeezing the tube by hand to dispense a quantity of product. However, manual operation of this type makes it difficult to regulate and direct the amount of product dispensed from the tube. Moreover, it is difficult to dispense the entire contents of the tube by manual operation.

The art has developed a variety of dispensing applicators which are used in combination with collapsible tubes to dispense the product therefrom. An example of one such device is shown in International Application No. WO 00/10880. This publication shows a gun type dispensing apparatus having a trigger-actuated pusher rod which may be advanced over the collapsible tube to squeeze the tube thereby dispensing product from the dispensing end of the tube. The pusher rod is advanced under the actuatable movement of a trigger such that the trigger pressure can be controlled thereby controlling movement of the pusher rod which in turn allows control of the amount of product dispensed from the tube.

While dispensing apparatuses of the type perform adequately in dispensing a measured amount of product from the tube, difficulties are seen in retracting the pusher rod to permit removal of the tube. Inevitably, a small amount of product remains in the tube after complete dispensing. This small amount of product may prevent the pusher rod from being easily retracted as the pusher rod, in its rearward motion, may have a tendency to push the unexpressed product backwards causing a buildup behind the pusher rod thereby blocking the easy retraction of the pusher rod.

It is, therefore, desirable to provide a squeeze tube applicator which allows for accurate dispensing of the product from the squeeze tube by advancing a pusher rod over the tube yet permits easy retraction of the pusher rod to permit removal of the tube from the applicator.

SUMMARY OF THE INVENTION

The present invention provides an apparatus for dispensing contents of a collapsible tube. The tube includes a dispensing end, an opposed closed and a deformable tubular wall therebetween. The apparatus includes a body for supporting the tube. The body includes a forward end for accommodating the dispensing end of the tube and a rearward end for accommodating the closed end of the tube.

An elongate actuatable plunger is supported by the body. The plunger includes an elongate rod and a base attached to the rod. The base is insertable into the open end of the body. Actuating means is provided for effecting movement of the plunger in a first direction along the body for engagement with the collapsible tube wall for deforming the tube wall and dispensing the contents of the tube from the dispensing end. The actuating means also provides for retractable movement of the plunger in a second direction opposite the first direction. The base is positioned on the rod for dispensing engagement with the tube upon movement of the plunger in the first direction and movable out of dispensing engagement with the tube upon movement in a second direction.

DETAILED DESCRIPTION OF THE PREFERRED EMBODIMENT

Figure 1:
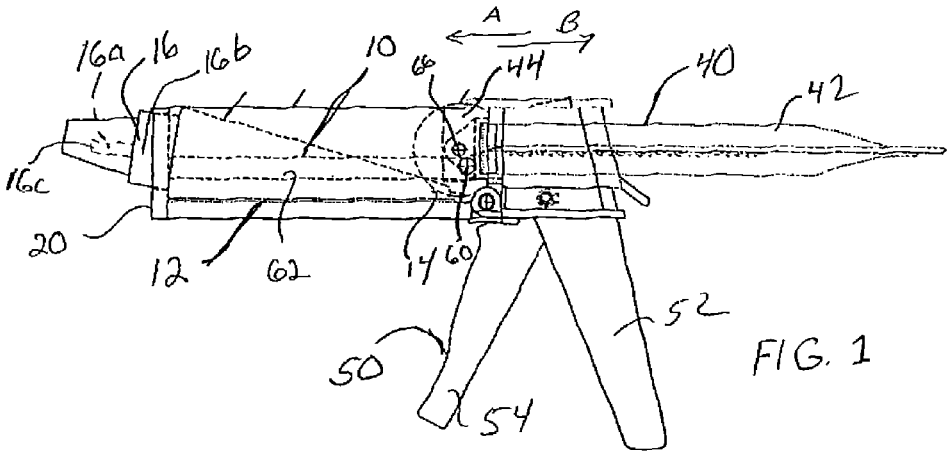
FIGS. 1 and 2 are side and top plan views, respectively, of the dispensing apparatus of the present invention.

The present invention is directed to a dispensing apparatus for dispensing the contents of a collapsible tube 10. The collapsible tube 10 includes an elongate collapsible tube wall 12, a closed end 14 and an opposed dispensing end 16 having a dispensing opening 16*c* in the form of a nozzle 16*a* which may be covered by a removable cap 16*b*. The contents of the tube is commonly dispensed through the opening 16*c* of nozzle 16*a*. While a wide variety of materials may be dispensed from the tube 10, the present invention has particular utility with dispensing adhesive products.

The dispensing apparatus 20 of the present invention is a gun-like tool of the type commonly known as a caulk gun. The apparatus is designed to support therein the collapsible tube 10 and to dispense contents therefrom.

The apparatus 20 includes a main body portion 22 in the form of a cradle for supporting the collapsible tube 10 therein. The body 22 is defined by a pair of upstanding side walls 24 and 26, a bottom wall 28, and a front wall 30 which is designed to accommodate the dispensing nozzle 16*a* of tube 10. The body defines an open ended cavity 29 for accommodating the tube 10 therein. The end 27 of body 22 opposite front wall 30 is open to permit insertion of plunger 40 as described hereinbelow.

An elongate plunger 40 is supported by the body 22 for movement linearly with respect thereto in the direction of arrow A. The plunger includes an elongate rod 42 and a base 44 mounted at one end of the rod 42. The base 44 is inserted into body 22 through open end 27 thereof. The rod 42 is actuatably coupled to a trigger assembly 50 which includes a stationary arm 52 and a movable arm 54. As is commonly known in the caulking gun art, repetitive actuation of the trigger assembly 50 causes linear movement of the plunger 40 within the body 22 of apparatus 20 in the direction of arrow A. The trigger mechanism is actuatable to effect movement of the plunger in a forward direction placing the base in dispensing engagement with the tube. The base 44 rides over collapsible tube 10, squeezing the collapsible walls thereof against bottom wall 28, and dispensing product contained therein through dispensing opening 16*c*.

Once the entire contents (or as much as can be dispensed) of tube 10 is dispensed, the trigger assembly 50 may be released from engagement with the plunger 46 so that the plunger 46 may be retracted in the direction of arrow B (opposite arrow A) thereby allowing removal of the dispensed tube 10 and reinsertion of another tube. During retraction of the plunger, as will be described hereinbelow, the base is moved out of dispensing engagement with the tube 10.

Figure 3:
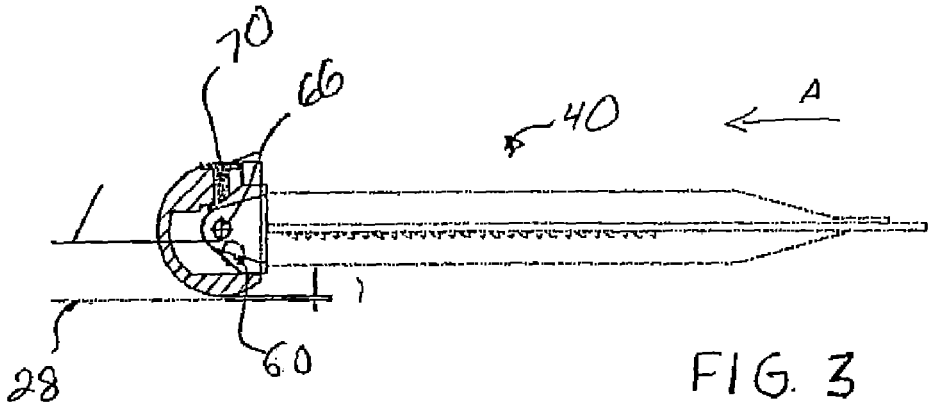
FIGS. 3 and 4 are side plan views of the plunger of the apparatus of FIGS. 1 and 2 shown in the dispensing and retracting positions, respectively.
Figure 4:
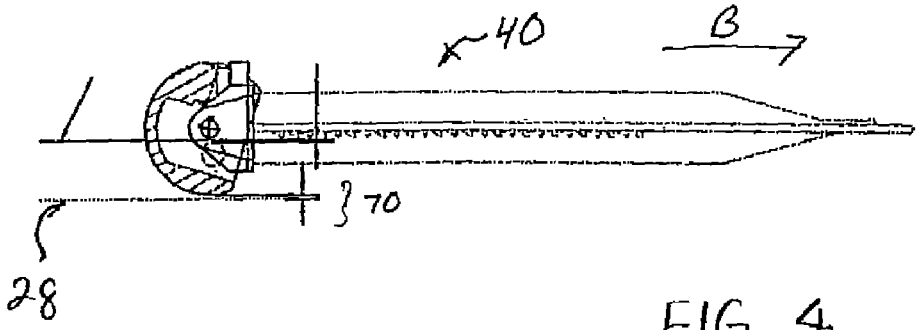

Referring additionally to FIGS. 3 and 4, the plunger 40 is retained for linear movement within body 22 by a pair of outwardly extending guide pins 60 which extend from either side of base 44. The guide pins 60 are designed to ride within elongate guide-like tracks 62 within the walls 24 and 26 of body 22. The guide pins 60 are moveable along the guide tracks 62 in both the forward (arrow A) and rearward (arrow B) directions. The riding of the guide pins 60 in the tracks 62 maintains the proper positioning and linear movement of the plunger 40 within body 22.

The base 44 of plunger 40 is rotatably coupled to the end of rod 42 by a pivot pin 66. The base 44 is rotatable about the pivot pin 66 against the bias of a spring 65 mounted between the base 44 and the forward end 42*a* of plunger rod 42. The rotative movement of the base 44 on the end of pivot rod 42 is shown in FIGS. 3 and 4. FIG. 3 shows movement of the plunger 40 in a forward direction (arrow A) with respect to the body 22 of apparatus 20 so as to express product from tube 10. In this position, the base 44 remains in compressive contact with the collapsible wall 12 of tube 10 against bottom wall 28 (FIGS. 1 and 2) so as to collapse the wall 12 forcing the product contained within the tube out of dispensing opening 16*c*.

FIG. 4 shows movement of the plunger 40 in a rearward direction (arrow B) with respect to body 22 so as to permit removal of the dispensed tube 10 from the body. In this position, resistance caused by remaining amounts of unexpressed product within tube 10 causes the base 44 to rotate in a clockwise direction about pivot pin 66 against the bias of spring 65. As will be described in further detail hereinbelow, this movement creates a gap between the base 44 and the bottom wall 28 of body 22 so as to allow the plunger 40 to retract more easily without continued resistance from the remaining product in the tube.

Figure 7:
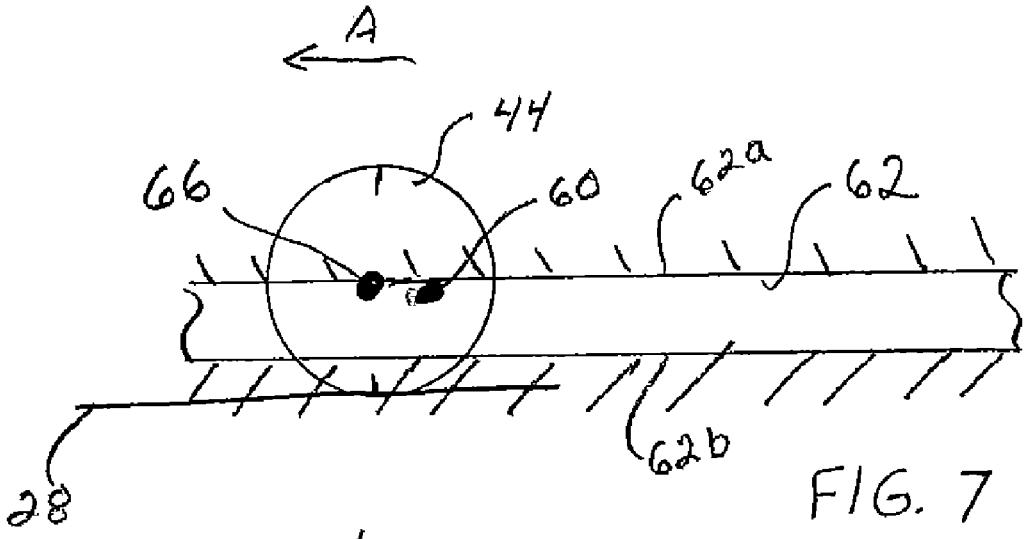
FIGS. 7, 8 and 9 are schematic representations of the movement of the base of the plunger shown in FIGS. 3-6 within the guide track of the body of the apparatus.
Figure 8:
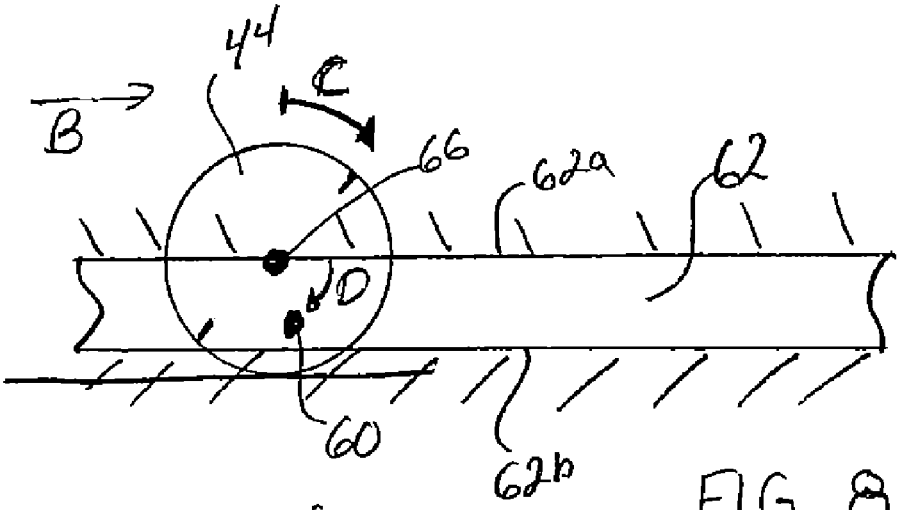
Figure 9:
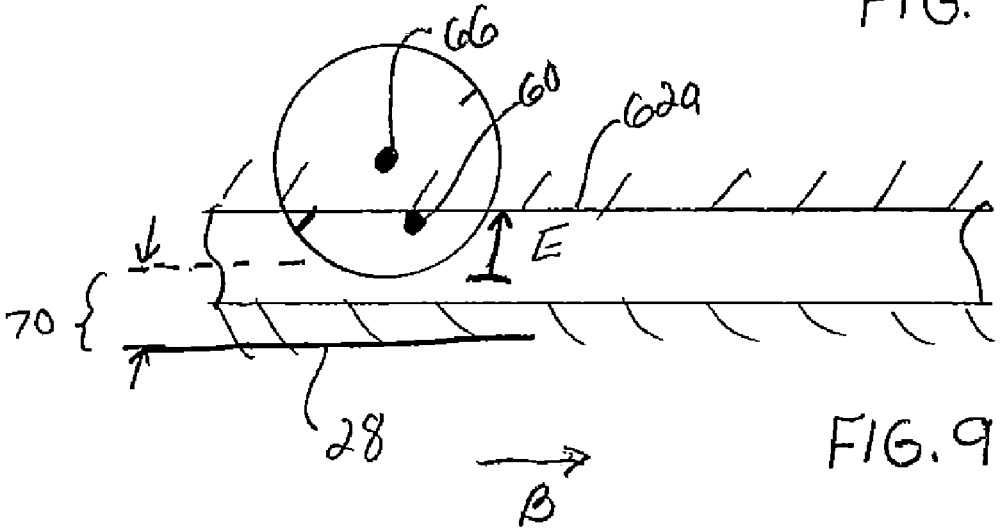

Referring now to FIGS. 7 through 9, the schematic representation of the movement of base 44 is shown.

Figure 2:
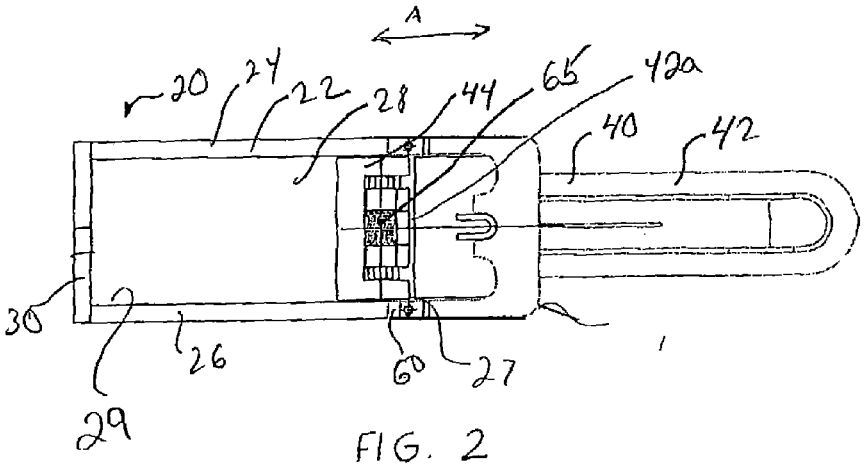

Referring now to FIGS. 1, 2 and 7, the initial position of the components of the apparatus 20 are shown. In the dispensing condition, base 44 rides along bottom wall 28 of body 22 with guide pins 60 supported within tracks 62 of side walls 24 and 26. The height of each track 62 is such that the guide pin 60 is positioned against the upper edge 62*a* of track 62 while the plunger 40 moves in the forward direction. In this position, the base 44 may ride along bottom wall 28 such that, as it advances in a dispensing direction indicated by arrow A. The base 44 collapses the wall 12 of tube 10 against bottom wall 28 to express the contents of tube 10 through dispensing end 16.

As shown in FIG. 8, after the contents of the tube is near fully expressed, the plunger 40 may move rearwardly in a direction of arrow B (opposite arrow A) to allow removal of the tube 20 from the body 22. Resistance caused by any product remaining within the collapsed tube 10 causes rotation of base 44 about its pivot pin 66 in a clockwise direction as indicated by arrow C. Such clockwise rotation of base 44 causes rotative movement of guide pin 60 in a clockwise direction as indicated by arrow D. This moves the guide pin 60 down off of upper edge 62*a*. This creates ability for the base 44 to move upward within the guide track 62 as shown in FIG. 9. Such upward movement in the direction of arrow E, caused in part by the resistance of the product remaining within the collapsed tube 10, raises the base 44 off of bottom wall 28 thereby defining a gap 70.

Since the base 44 has been rotated clockwise, and the guide pin 60 moved off of upper edge 62*a* as shown in FIG. 8, the base 44 is free to move upwardly placing the rotated guide pin 60 back against the upper edge 62*a* of gap 62. The plunger 40 may now be continued to be retracted along the direction of arrow B as the gap 70 allows free retraction without resistance caused by remaining product within tube 10.

Once the plunger 40 is fully retracted and the tube 10 is removed from body 22, the resistance caused by the remaining product is relieved, and the base 44 will rotate back, with the bias of the spring 65, to its original position shown in FIG. 7. An additional tube 10 may be inserted into the apparatus 20 for further use.

While the apparatus 20 shown in FIGS. 1 through 4 adequately serves to provide a gap between the base of the plunger and the bottom wall of the body to permit extraction of the tube, a further embodiment of the present invention enhances the gap to more easily permit removal of the tube from the body.

Figure 5:
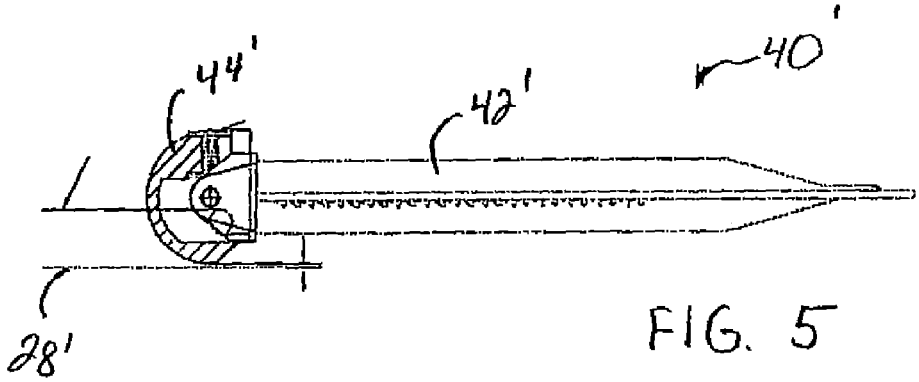
FIGS. 5 and 6 are side plan views of an alternative embodiment of the plunger of the present invention.
Figure 6:
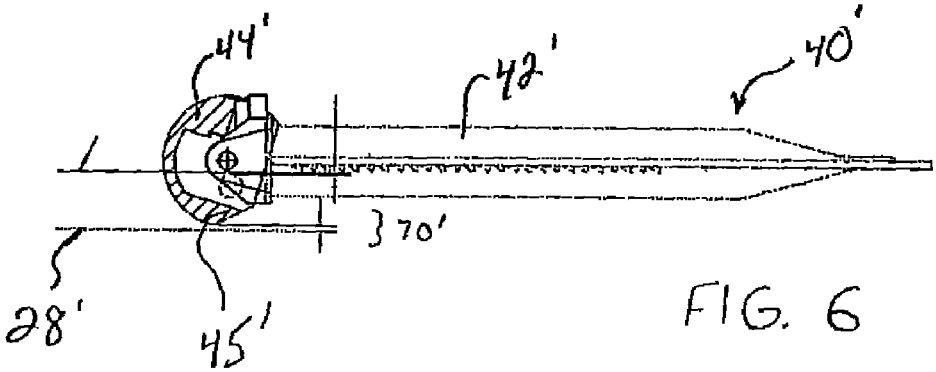

As shown in FIGS. 5 and 6, a plunger 40' substantially similar to that described above is provided. Plunger 40' includes a plunger rod 42' and a base 44' substantially as described above.

A portion of the base 44' adjacent to bottom wall 28' includes a chamfered edge 45' such that upon rotation of the base, as the plunger is being retracted, the flat chamfered edge 45' is placed in facing relationship with the bottom wall 28'. This provides an increase in the gap 70' during retraction. This increased gap 70' further facilitates ease of retraction of the plunger 40' from the apparatus.

While the invention has been described in relationship to the preferred embodiments, it will be understood by those skilled in the art that various changes may be made without deviating from the fundamental nature and scope of the invention as defined in the appended claims.

What is claimed is:

1. An apparatus for dispensing contents from a collapsible tube having a dispenser end, an opposed closed end and a deformable tube wall therebetween, said apparatus comprising:

a body for supporting said tube, said body having a forward end for accommodating said dispensing end of said tube, an open rearward end, and a body wall extending between said forward end and said open rearward end;

an elongate actuatable plunger supported by said body, said plunger having an elongate rod and a base attachable to one end of said rod, said base being insertable into said open end of said body and said base being movable on said plunger rod against the bias of a spring; and actuating means for effecting movement of said plunger into a first direction along said body for engagement with said collapsible tube wall for progressively deforming said tube wall against said body wall and dispensing said contents from said dispensing end and for effecting retractable movement of said plunger in a second direction opposite said first direction;

said base being positioned on said rod for dispensing engagement with said tube wall upon movement of said plunger in said first direction and moveable out of dispensing engagement with said tube wall upon movement in said second direction.

2. An apparatus of claim 1 wherein said actuating means includes a trigger coupled to said plunger rod to effect said movement of said plunger in said first direction.

3. An apparatus of claim 2 wherein said trigger is releasably coupled to said plunger rod to permit movement of said plunger in said second direction.

4. An apparatus of claim 1 wherein said body includes an open end cavity for accommodating said collapsible tube.

5. An apparatus of claim 4 wherein said plunger is movable within said cavity.

6. An apparatus of claim 1 wherein said base has an arcuate surface for engagement with said collapsible tube.

7. An apparatus of claim 1 wherein said base is rotatably movable on said plunger rod against the bias of the spring.

8. An apparatus of claim 1 wherein said base is rotatably movable about a pivot pin connecting said base to said plunger rod.

9. An apparatus for dispensing contents from a collapsible tube having a dispenser end, an opposed closed end and a deformable tube wall therebetween, said apparatus comprising:

a body for supporting said tube, said body having a forward end for accommodating said dispensing end of said tube, an open rearward end, and a body wall extending between said forward end and said open rearward end;

an elongate actuatable plunger supported by said body, said plunger having an elongate rod and a base attachable to one end of said rod, said base being insertable into said open end of said body and rotatably movable about a pivot pin connecting said base to said plunger rod; and actuating means for effecting movement of said plunger into a first direction along said body for engagement with said collapsible tube wall for progressively deforming said tube wall against said body wall and dispensing said contents from said dispensing end and for effecting retractable movement of said plunger in a second direction opposite said first direction;

said base being positioned on said rod for dispensing engagement with said tube wall upon movement of said plunger in said first direction and moveable out of dispensing engagement with said tube wall upon movement in said second direction;

wherein said body includes a guide track and said plunger includes a guide pin, said guide pin being movable longitudinally within said guide track upon said movement of said plunger in said body.

10. An apparatus of claim 9 wherein said guide pin is movable transversely within said guide track.

11. An apparatus of claim 10 wherein said guide pin and said pivot pin are radially offset.

12. An apparatus of claim 11 wherein said base is rotatable on said pivot pin from a first position wherein said guide pin engages an upper edge of said guide track to a second position wherein said guide pin is moved off of said upper edge of said guide track.

13. An apparatus of claim 12 wherein said base is transversely movable upon movement of said plunger in said second direction.

14. An apparatus of claim 13 wherein said body includes a bottom wall for supporting said collapsible tube.

15. An apparatus of claim 14 wherein said base is positioned in squeeze engagement with said collapsible wall against said bottom wall upon movement in said first direction.

16. An apparatus of claim 15, wherein said base is movable out of said squeeze engagement with said collapsible wall upon movement in said second direction.

* * * * *